US008381697B2

(12) United States Patent
Yasui et al.

(10) Patent No.: US 8,381,697 B2
(45) Date of Patent: Feb. 26, 2013

(54) INTERNAL COMBUSTION ENGINE

(75) Inventors: Shinsuke Yasui, Saitama (JP); Yukihiro Tsubakino, Saitama (JP); Kazuya Shindome, Wako (JP); Isao Azumagakito, Saitama (JP); Akio Senda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 738 days.

(21) Appl. No.: 12/499,397

(22) Filed: Jul. 8, 2009

(65) Prior Publication Data

US 2010/0024761 A1 Feb. 4, 2010

(30) Foreign Application Priority Data

Jul. 31, 2008 (JP) ..... 2008-197884

(51) Int. Cl.
*F01M 9/10* (2006.01)

(52) U.S. Cl. ..... 123/196 R; 123/196 CP; 123/196 A

(58) Field of Classification Search ..... 123/196 R, 123/196 CP, 196 A, 195 R, 1 A
See application file for complete search history.

(56) References Cited

U.S. PATENT DOCUMENTS

| | | | | |
|---|---|---|---|---|
| 2,089,346 | A * | 8/1937 | Doba, Jr. | 323/228 |
| 3,722,623 | A * | 3/1973 | Waldecker | 184/6.3 |
| 5,632,241 | A * | 5/1997 | Binversie et al. | 123/196 W |
| 6,394,061 | B2 * | 5/2002 | Ryu et al. | 123/196 R |
| 6,497,211 | B2 * | 12/2002 | Nomura et al. | 123/195 R |
| 6,948,471 | B1 * | 9/2005 | Odashima | 123/196 R |
| 7,029,346 | B2 * | 4/2006 | Yoshida et al. | 440/88 L |
| 7,089,905 | B2 * | 8/2006 | Tsutsumi et al. | 123/196 R |
| 2001/0029921 | A1 * | 10/2001 | Ito et al. | 123/196 R |
| 2003/0037752 | A1 * | 2/2003 | Nomura | 123/192.2 |
| 2004/0031631 | A1 | 2/2004 | Pichler et al. | |
| 2005/0193974 | A1 * | 9/2005 | Terada et al. | 123/196 R |
| 2005/0217618 | A1 * | 10/2005 | Watanabe et al. | 123/78 F |
| 2007/0246000 | A1 * | 10/2007 | Takemoto et al. | 123/196 R |

FOREIGN PATENT DOCUMENTS

| | | | |
|---|---|---|---|
| EP | 1 849 969 | A1 | 10/2007 |
| JP | 2005-061386 | A | 3/2005 |

* cited by examiner

*Primary Examiner* — Noah Kamen
*Assistant Examiner* — Long T Tran
(74) *Attorney, Agent, or Firm* — Birch, Stewart, Kolasch & Birch, LLP

(57) ABSTRACT

An internal combustion engine for reducing the amount of bubbles contained in the circulated oil without reducing the ground clearance of the engine. A crankcase is provided therein with an oil suction passage makes an oil pump and an end part of a bottom wall of an oil sump chamber communicate with each other, passes between the oil sump chamber and a hanger boss, and has a lowest part located below the bottom wall of the oil sump chamber.

19 Claims, 10 Drawing Sheets

INTERNAL COMBUSTION ENGINE

CROSS-REFERENCE TO RELATED APPLICATIONS

The present application claims priority under 35 USC 119 to Japanese Patent Application No. 2008-197884 filed on Jul. 31, 2008 the entire contents of which are hereby incorporated by reference.

BACKGROUND OF THE INVENTION

1. Field of the Invention

The present invention relates to an internal combustion engine having a lubrication structure for circulating an oil.

2. Background Art

An internal combustion engine is known with a lubrication structure for circulatorily supplying an oil to sliding parts. In such an internal combustion engine, a structure has been adopted in which the oil is supplied to the sliding parts (e.g., a generator, a crankshaft, etc.) by use of an oil pump. The oil having lubricating the sliding parts flows down into an oil sump chamber provided at a lower part of the crankcase. The oil having flowed down into and reserved in the oil sump chamber is pumped up by the oil pump, and is again circulatorily supplied to the sliding parts. See, for example, Japanese Patent Laid-open No. 2005-61386.

On the other hand, for an offroad motorcycle, it is desirable that the minimum ground clearance of the engine should be as large as possible, in order to enhance the operation through performance.

In order to maintain the lubricating performance of oil, it is preferable to prevent bubbles from being contained in the oil. In the above-mentioned lubrication structure for circulating the oil to the sliding parts, however, bubbles may mix into the oil during when the oil flows down. More specifically, when the splashed oil comes directly into an oil introduction port of the oil sump chamber, the splashed oil impinges on the oil being reserved, making it easier for bubbles to mix into the oil. Consequently, the bubbles mixed in the oil in the oil sump chamber may be pumped up by the oil pump.

In addition, the bubbles move toward the upper side through the oil in the oil sump chamber. In view of this, it may be contemplated to pump up the oil from the lower side of the oil sump chamber so as to reduce the amount of bubbles contained in the oil thus pumped up. In order to pump up the oil from the lower side, however, an oil passage has to bulge to the lower side of the crankcase, so that the ground clearance of the engine cannot be made large.

SUMMARY AND OBJECTS OF THE INVENTION

The present invention has been made in consideration of the above-mentioned circumstances. Accordingly, it is an object of an embodiment of the present invention to provide an internal combustion engine such that the amount of bubbles contained in an oil to be circulated can be reduced, without reducing the ground clearance of the engine.

In order to attain the above object, according to an embodiment of the present invention, there is provided an internal combustion engine including a crankcase composed of a pair of cases, the cases being coupled to each other at mating surfaces orthogonal to an axis of a crankshaft; an oil sump chamber located below the crankshaft and formed at a lower part of the crankcase in the manner of ranging across said mating surfaces; an engine hanger boss provided in the crankcase and disposed adjacent to the oil sump chamber; and an oil pump for sucking an oil from the oil sump chamber; wherein the crankcase is provided therein with an oil suction passage which makes the oil pup and an end part of a bottom wall of the oil sump chamber communicate with each other, passes between the oil sump chamber and the hanger boss, and has a lowest part located below the bottom wall of the oil sump chamber.

According to this configuration, it is unnecessary for the oil suction passage to bulge to the lower side of the bottom wall of the oil sump chamber. In addition, since the oil passes through the lowest part which is located below the bottom wall of the oil sump chamber, it is made difficult for the bubbles in the oil to pass through the lowest part.

In addition, the oil suction passage may have an oil passage of which a portion passing between the oil sump chamber and the engine hanger boss is partly extended vertically and which is disposed adjacent to the oil sump chamber.

According to this configuration, the region required for arranging the oil suction passage can be configured to be compact, without changing the position of the engine hanger boss, in the vehicle body front-rear direction of the crankcase.

Furthermore, the crankcase may have a mounting boss for coupling of the crankcase, the mounting boss being provided adjacent to the oil suction passage, and the oil suction passage may be disposed along the outer circumference of the mounting boss.

According to this configuration, the oil suction passage can be formed along the R (round) shape of the outer circumference of the mounting boss.

In the internal combustion engine according to an embodiment of the present invention, the crankcase is provided with an oil suction passage which makes the oil pump and an end part of the bottom wall of the oil sump chamber communicate with each other, passes between the oil sump chamber and the engine hanger boss, and has a lower most part located below the bottom wall of the oil sump chamber. Therefore, it is unnecessary for the oil suction passage to bulge to the lower side of the bottom wall of the oil sump chamber, and an increase in the size of the crankcase can be obviated. Accordingly, the ground clearance of the engine is prevented from being reduced.

In addition, since the oil passes through the lowest part which is located below the bottom wall of the oil sump chamber, it is difficult for the bubbles in the oil to pass through the lowest part, and the amount of the bubbles sucked into the oil pump can be reduced.

In addition, the oil suction passage has an oil passage of which a portion passing between the oil sump chamber and the engine hanger boss is partly extended vertically and which is disposed adjacent to the oil sump chamber. Therefore, the region required for arranging the oil suction passage can be effectively utilized, without changing the position of the engine hanger boss, in the vehicle front-rear direction of the crankcase. Consequently, the oil sump chamber can be enlarged to a position adjacent to the oil suction passage, and it is possible to securely provide the oil sump chamber with a large inside volume.

Furthermore, the crankcase has a mounting boss for coupling of the crankcase, the mounting boss being adjacent to the oil suction passage, and the oil suction passage is disposed along the outer circumference of the mounting boss. Accordingly, it is possible to dispose the oil suction passage and the mounting boss closer to each other, by forming the oil suction passage along the R shape of the outer circumference of the mounting boss. Accordingly, the oil sump chamber can be formed to be larger, and the oil suction passage can be configured to be compact, so that an increase in the size of the crankcase can be obviated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
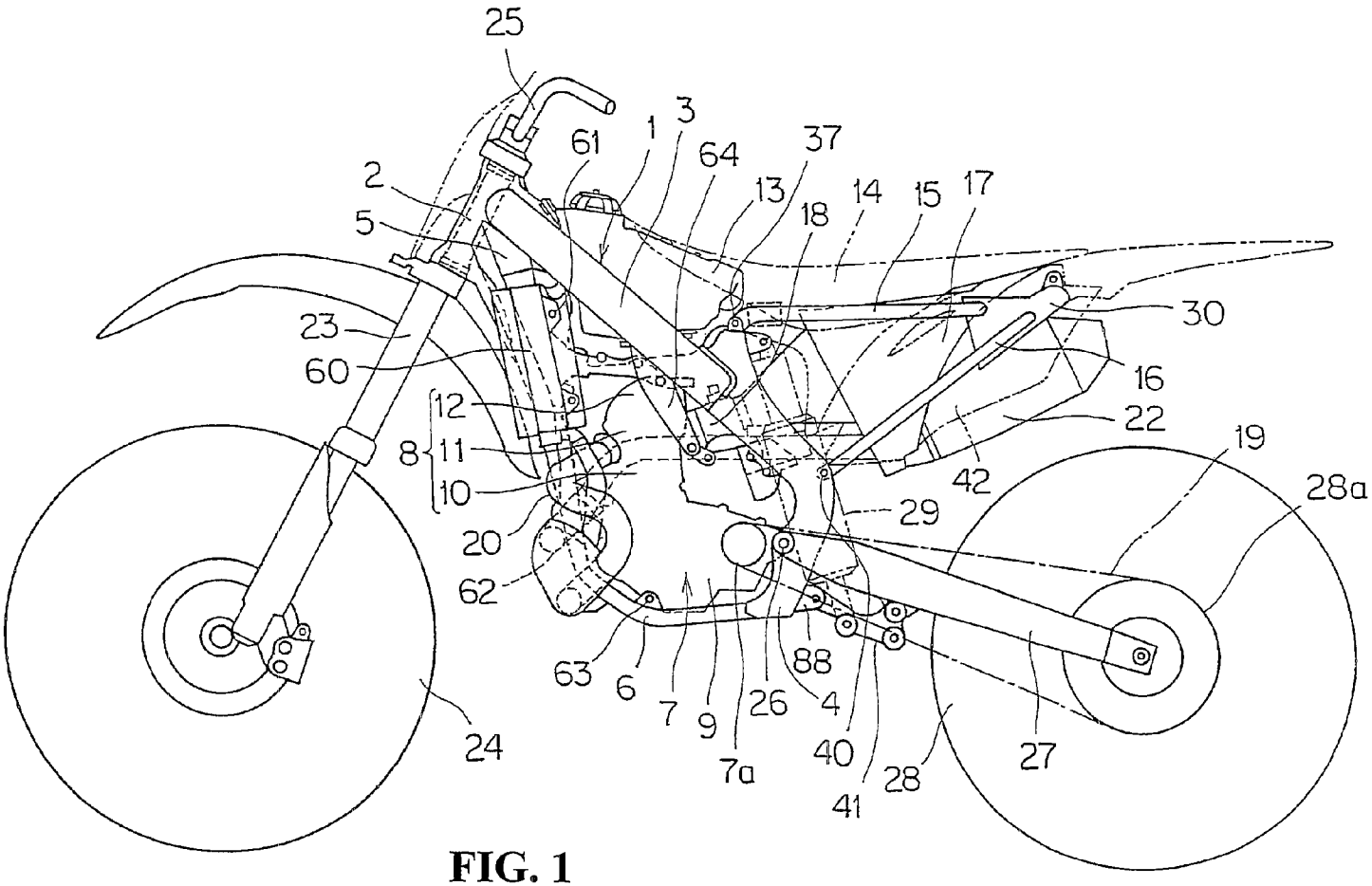
FIG. 1 is a side view of a motorcycle according to an embodiment of the present invention.

An internal combustion engine according to an embodiment of the present invention will be described below referring to the drawings. The directions upward and downward, forward and rearward, and leftward and rightward directions in the following description refer to the directions as viewed from the driver.

FIG. 1 is a side view of an offroad motorcycle according to an embodiment of the present invention.

A body frame 1 of this motorcycle includes a head pipe 2, main frames 3, center frames 4, a down frame 5 and lower frames 6, which are connected to one another in a loop form, and an engine 7 is supported on the inside thereof. The engine 7 has a cylinder 8 and a crankcase 9. The main frames 3, the center frames 4 and the lower frames 6 are provided in left-right pairs, whereas the head pipe 2 and the down frame 5 are provided as single members along the center of the vehicle body.

The main frames 3 extend over the engine 7 rectilinearly and downwardly rearwards, and are connected to upper end parts of the center frames 4 which extend vertically on the rear side of the engine 7. The down frame 5 extends skewly downward on the front side of the engine 7, and is connected to front end parts of the lower frames 6 at its lower end part. The lower frames 6 are bent from a front side lower part of the engine 7 toward the lower side of the engine 7, extend substantially rectilinearly rearwards, and are connected to lower end parts of the center frames 4 at their rear end parts.

The engine 7 is of a water-cooled four-cycle system. The cylinder 8 is provided at a front part of the crankcase 9 in an upright state with its axis substantially vertical, and has a cylinder block 10, a cylinder head 11, and a head cover 12 in this order from the lower side toward the upper side. With the cylinder 8 thus set upright, the engine 7 is made short in the front-rear direction, and the engine 7 is suited to an offroad vehicle.

A fuel tank 13 is disposed on the upper side of the engine 7, and is supported on the main frames 3. An incorporated type fuel pump (see FIG. 6) is contained in the inside of the fuel tank 13, and a high-pressure fuel is supplied from the fuel pump to a throttle body 18 through a fuel supply pipe.

A seat 14 is disposed on the rear side of the fuel tank 13, and is supported on seat rails 15 extending rearwards from the upper ends of the center frame 4. Rear frames 16 are disposed on the lower side of the seat rails 15. An air cleaner 17 is supported by the seat rails 15 and the rear frames 16, and intake into the cylinder head 11 is conducted through the throttle body 18 from the vehicle body rear side.

An exhaust pipe 20 is provided at a front part of the cylinder 8. The exhaust pipe 20 extends from the front part of the cylinder 8 toward the front side of the crankcase 9, is bent to the right side, and is laid to extend rearwards on the right side of the vehicle body. A muffler 22 extends rearwards from the exhaust pipe 20. A rear end part of the muffler 22 is supported by the rear frames 16.

A front fork 23 is supported by the head pipe 2, and a front wheel 24 supported by lower end parts of the front fork 23 is steered by a handle 25. A front end part of a rear arm 27 is swingably supported on the center frames 4 by a pivot shaft 26. A rear wheel 28 is supported on a rear end part of the rear arm 27, and is driven by a drive chain 19 wrapped around a drive sprocket 7*a* of the engine 7 and a driven sprocket 28*a* on the rear wheel 28. A shock absorber 29 of rear suspension is provided between the rear arm 27 and rear end parts of the center frames 4.

As illustrated in FIG. 1, a radiator 60 is provided together with a rubber mount part 61 thereof, engine mount parts 62 and 63, and an engine hanger 64. The engine 7 is supported on the center frames 4 also through the pivot shaft 26.

Figure 2:
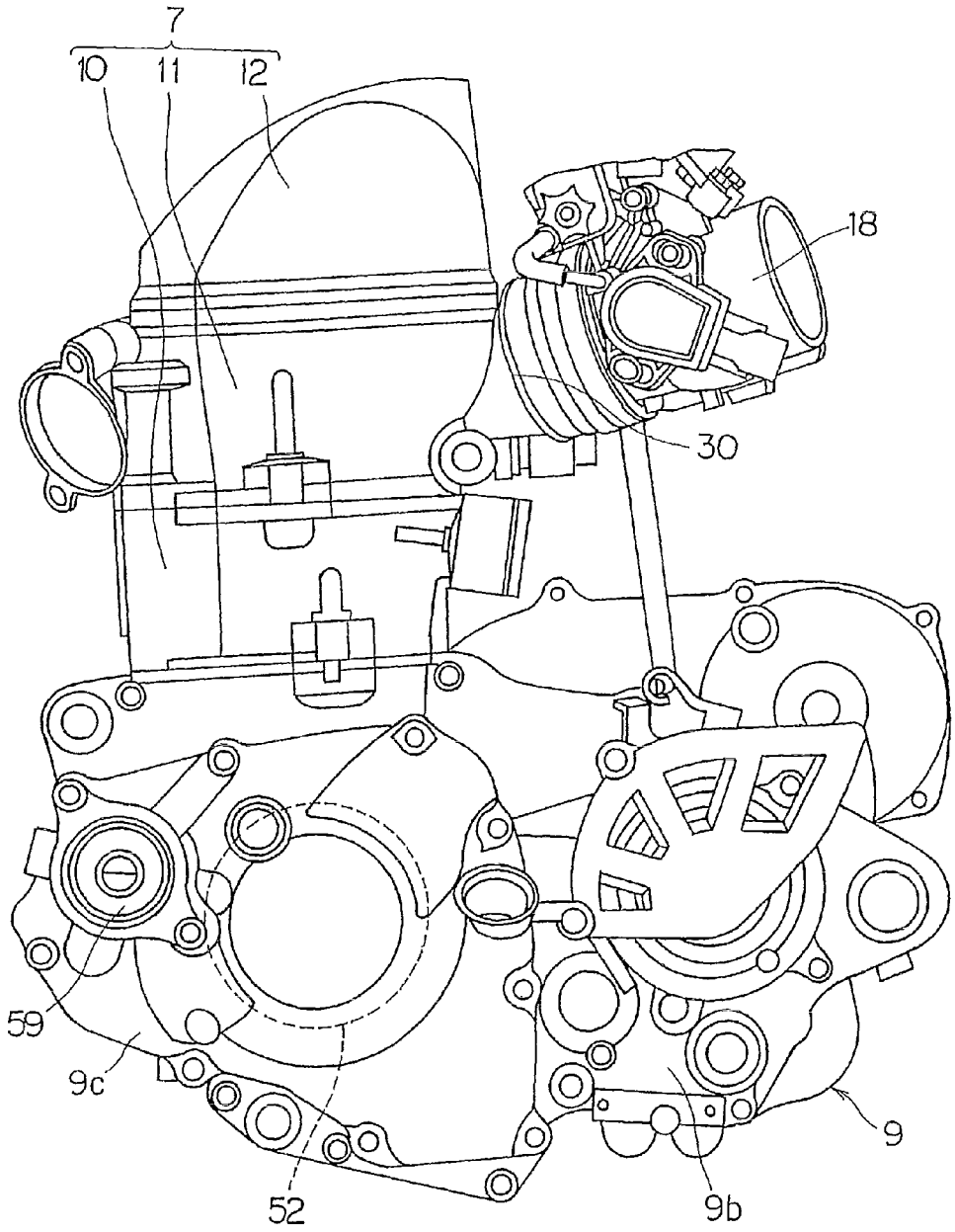
FIG. 2 is a side view of a water-cooled four-cycle single-cylinder engine.

FIG. 2 is a side view of the water-cooled four-cycle single-cylinder engine 7. The engine 7 is composed of the cylinder block 10, the cylinder head 11, the head cover 12, and the crankcase 9, as above-mentioned. The crankcase 9 is assembled by a method in which a right-side case 9*a* and a left-side case 9*b* provided as a pair being splittable in the vehicle body width direction are coupled to each other at mating surfaces 80*a*, 80*b* (for details, see FIGS. 5 and 6) orthogonal to the rotational axis of the crankshaft 40. A crankcase cover 9*c* is attached to a left side surface of the crankcase 9 through a gasket (not shown), and a right-side case cover 9*d* (see FIG. 4) is attached to a right side surface of the crankcase 9.

The cylinder head 11 is provided, on the vehicle body rear side thereof, with an intake port 30 through which a fuel-air mixture from the throttle body 18 is supplied into the engine 7. The intake port 30 is opened and closed through an intake valve 33 moved up and down by a cam 31 and a valve lifter 32 both provided inside the head cover 12, and the fuel-air mixture is supplied into a combustion chamber. Similarly, the cylinder head 11 is provided with an exhaust port (not shown) on the vehicle body front side thereof, and a combustion gas generated in the combustion chamber is exhausted through the exhaust port.

The cylinder block 10 is provided with a cylinder part 35 in which a piston 34 can be reciprocated in the vertical direction (more accurately, a direction slightly inclined toward a front upper side).

Figure 3:
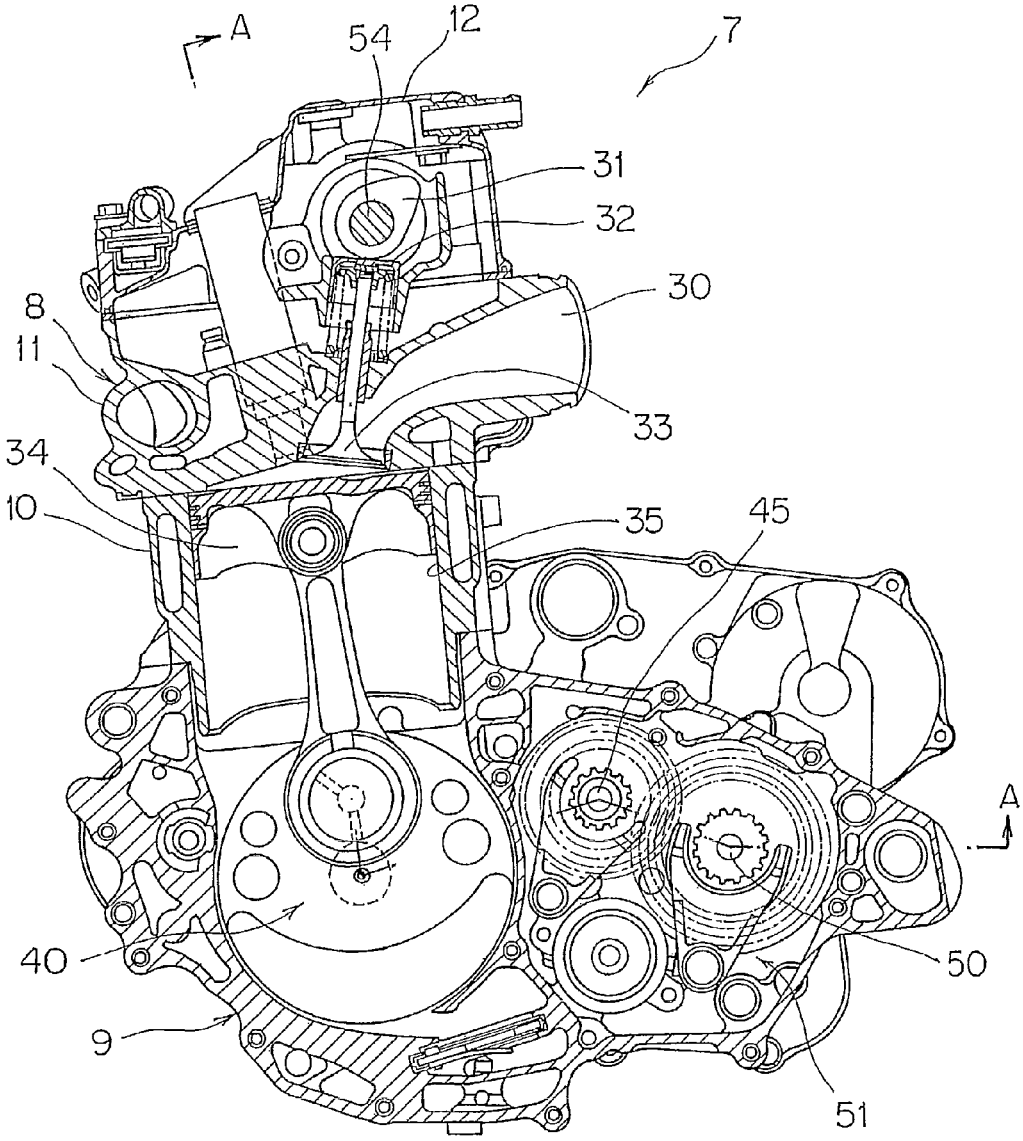
FIG. 3 is a side part sectional view of the engine.

On the other hand, as shown in FIG. 3, a crankshaft 40 located on the lower side of the piston 34, a main shaft 45 located on the vehicle body rear side of the crankshaft 40, and a drive shaft 50 located further on the vehicle body rear side of the main shaft 45 are provided inside the crankcase 9. Rotational axes of the crankshaft 40, the main shaft 45, and the drive shaft 50 are disposed parallel to one another, and motive power is transmitted to them by gears which will be described later.

In addition, a primary reduction gear 46 rotated together with the crankshaft 40 is provided at a part on the vehicle body right side of the crankshaft 40. The primary reduction gear 46 is meshed with a housing gear 47*a* of a multiple disk clutch 47 disposed on the main shaft 45. This ensures that the rotational power of the crankshaft 40 is transmitted through the primary reduction gear 46 and the multiple disk clutch 47 to the main shaft 45.

Figure 4:
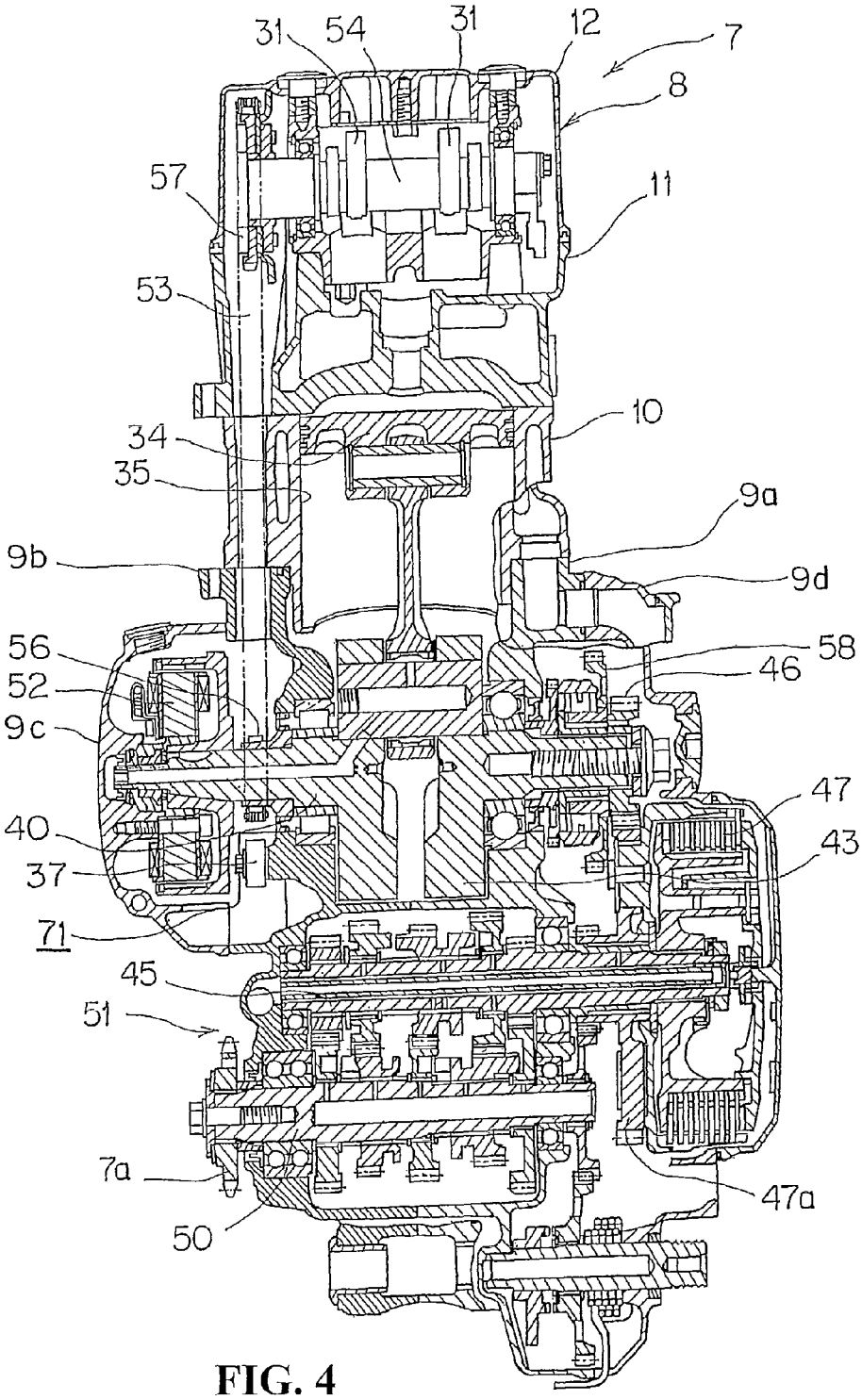
FIG. 4 is a sectional view taken along line A-A of FIG. 3.

As shown in FIG. 4, a generator 52 is attached to a left end part of the crankshaft 40. The generator 52 is located on the left side of the crankcase 9. A left outside part of the generator 52 is covered by a crankcase cover 9*c*.

In addition, a cam chain 53 for transmitting the power of the crankshaft 40 to a camshaft 54 is disposed on the inner side (the cylinder head side) of the generator 52. The cam chain 53 is wrapped around a crankshaft sprocket 56 provided on the crankshaft 40 and a cam sprocket 57 provided on the camshaft 54, so as to transmit power to the camshaft 54.

An oil pump 86 (indicated by dotted line in FIG. 5) for supplying a lubricating oil to sliding parts (a shaft part of the crankshaft 40, sliding parts of the cam chain 53 and the generator 52, and the like) inside the engine 7 is attached to the crankcase 9. The oil pump 86 is driven by power obtained from a pump gear 58 (see FIG. 4) provided on the crankshaft 40. In addition, as shown in FIG. 2, an oil filter 59 is attached to the crankcase cover 9*c*, and an oil pump 86 is provided on the depth side of the oil filter 59 shown in FIG. 2 (on the side of the inside of the engine 7).

The cam chain 53, the crankshaft sprocket 56, and the cam sprocket 57 mentioned above are disposed in a generator chamber 71 partitioned at a left side part of the crank chamber by a wall part 70. The generator chamber 71 is so configured that the oil having lubricated the camshaft 54 flows down to a lower part of the engine 7.

Figure 5:
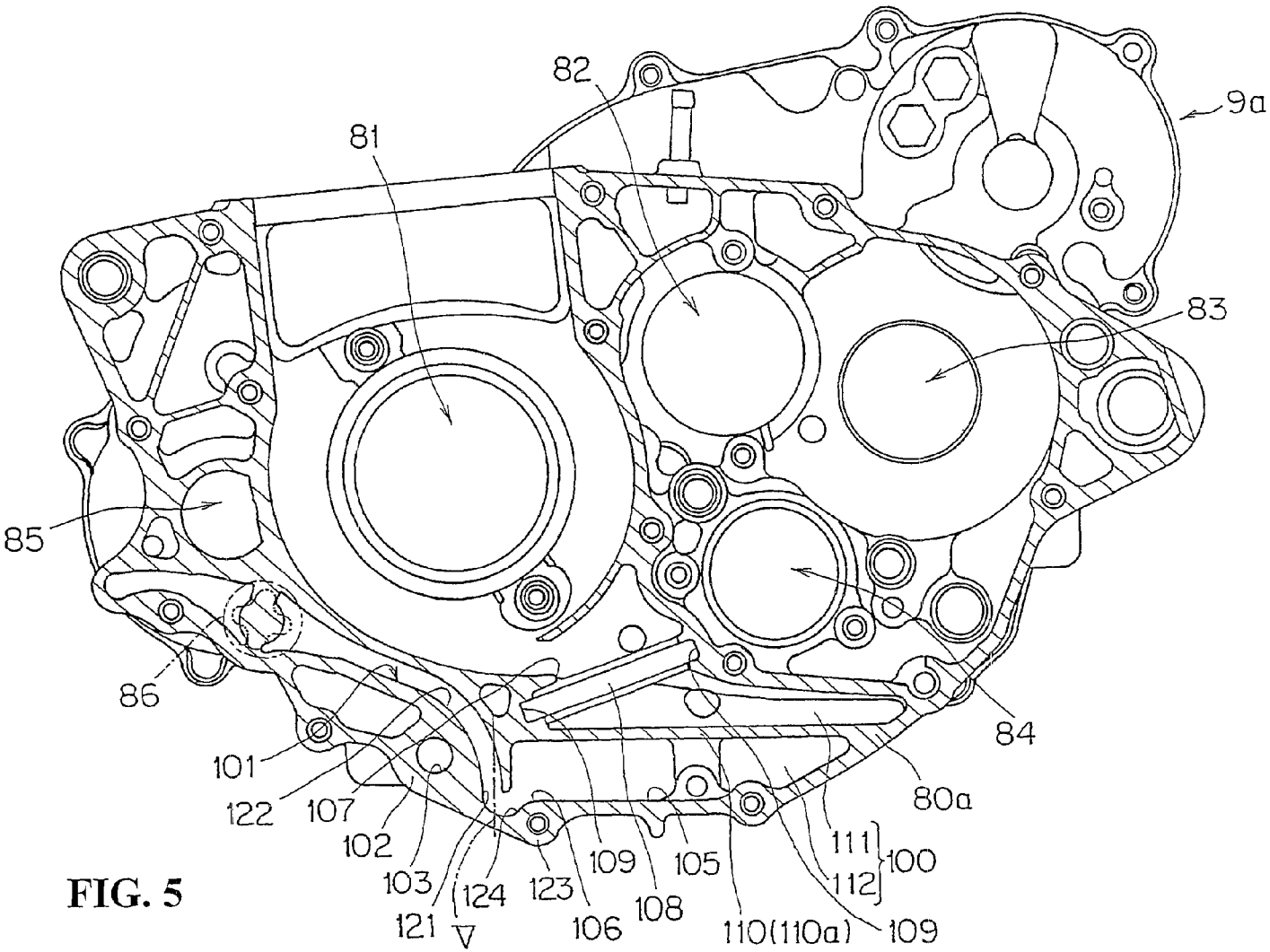
FIG. 5 is a view of a right-side case as a crankcase half, as viewed from the mating surface side.
Figure 6:
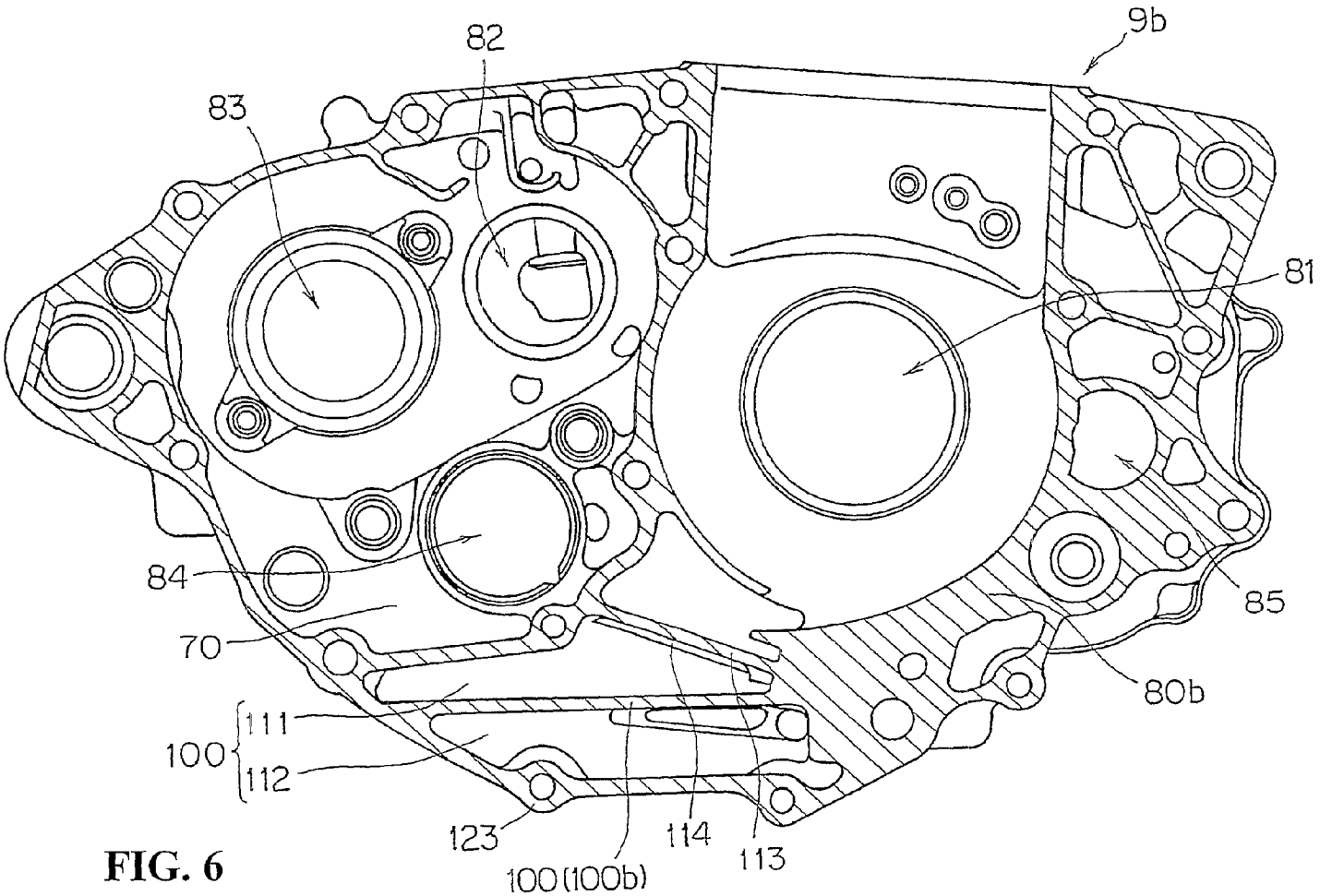
FIG. 6 is a view of a left-side case as a crankcase half, as viewed from the mating surface side.

FIG. 5 is a side view of the right-side case 9*a* of the crankcase 9 as viewed from the mating surface 80*a* side. FIG. 6 is a side view of the left-side case 9*b* as viewed from the mating surface 80*b* side. The mating surface 80*a* shown in FIG. 5 and the mating surface 80*b* shown in FIG. 6 are hatched for permitting easy confirmation of these surfaces.

Figure 7:
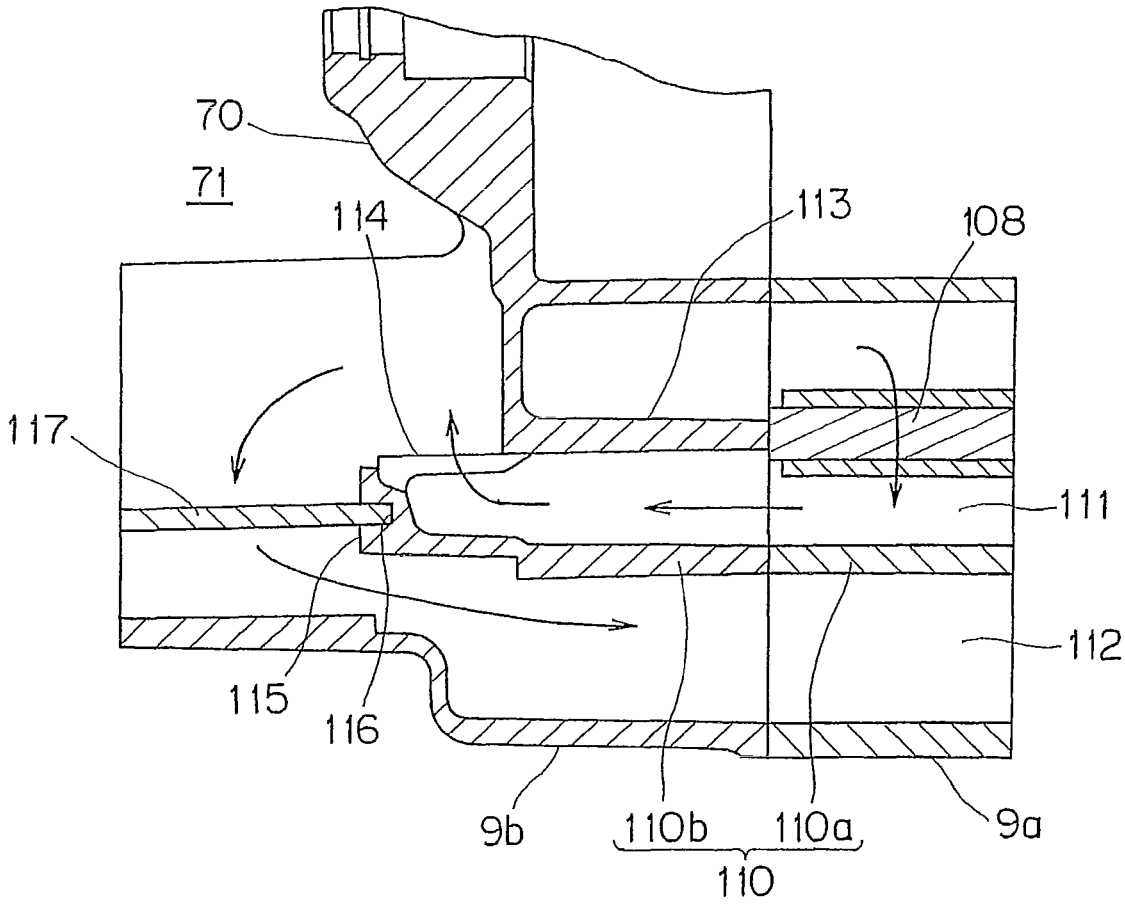
FIG. 7 is a schematic illustration of the flow of an oil in a lower part of a crankcase.

In addition, FIG. 7 is a sectional view in the vehicle body width direction of an oil sump chamber 100 in the condition where the right-side and left-side cases 9*a* and 9*b* are mated with each other. The right-side case 9*a* and the left-side case 9*b* are coupled to each other at their mating surfaces 80*a*, 80*b*, whereby the crankcase 9 is assembled. The right-side case 9*a* and the left-side case 9*b* are each provided with a crankshaft mounting part 81, a main shaft mounting part 82, a drive shaft mounting part 83, a shaft drum mounting part 84, an oil pump mounting part 85 and the like in the crank chamber, at corresponding positions in the combined state thereof.

In addition, the right-side case 9*a* and the left-side case 9*b* are provided with the oil sump chamber 100 on the lower side of the crankshaft mounting part 81. More specifically, the oil sump chamber 100 is formed in the manner of ranging across the mating surfaces 80*a*, 80*b* of the right-side case 9*a* and the left-side case 9*b*, and an integral oil sump chamber 100 is formed in the condition where the oil sump chamber 100 formed in the right-side case 9*a* and the oil sump chamber formed in the left-side case 9*b* are combined with each other at the mating surfaces 80*a*, 80*b*.

The oil sump chamber 100 is a chamber in which the oil for lubricating the inside of the engine 7 is reserved. The engine 7 is so designed that the lubricating oil is used while being circulated. The oil reserved in the oil sump chamber 100 is pumped up by the oil pump 86, is supplied to the sliding parts (the crankshaft 40 in the crank chamber, the camshaft 54, the generator 52, etc.) to lubricate the latter, and then flows down by gravity, to again enter the oil sump chamber 100.

The interior of the oil sump chamber 100 is partitioned by a partition wall 110 (its part on the right-side case 9*a* side is referred to as partition wall 110*a*, and its part on the left-side case 9*b* side is referred to as partition wall 110*b*) into a first oil sump chamber 111 located on the upper side and a second oil sump chamber 112 located on the lower side.

Figure 8:
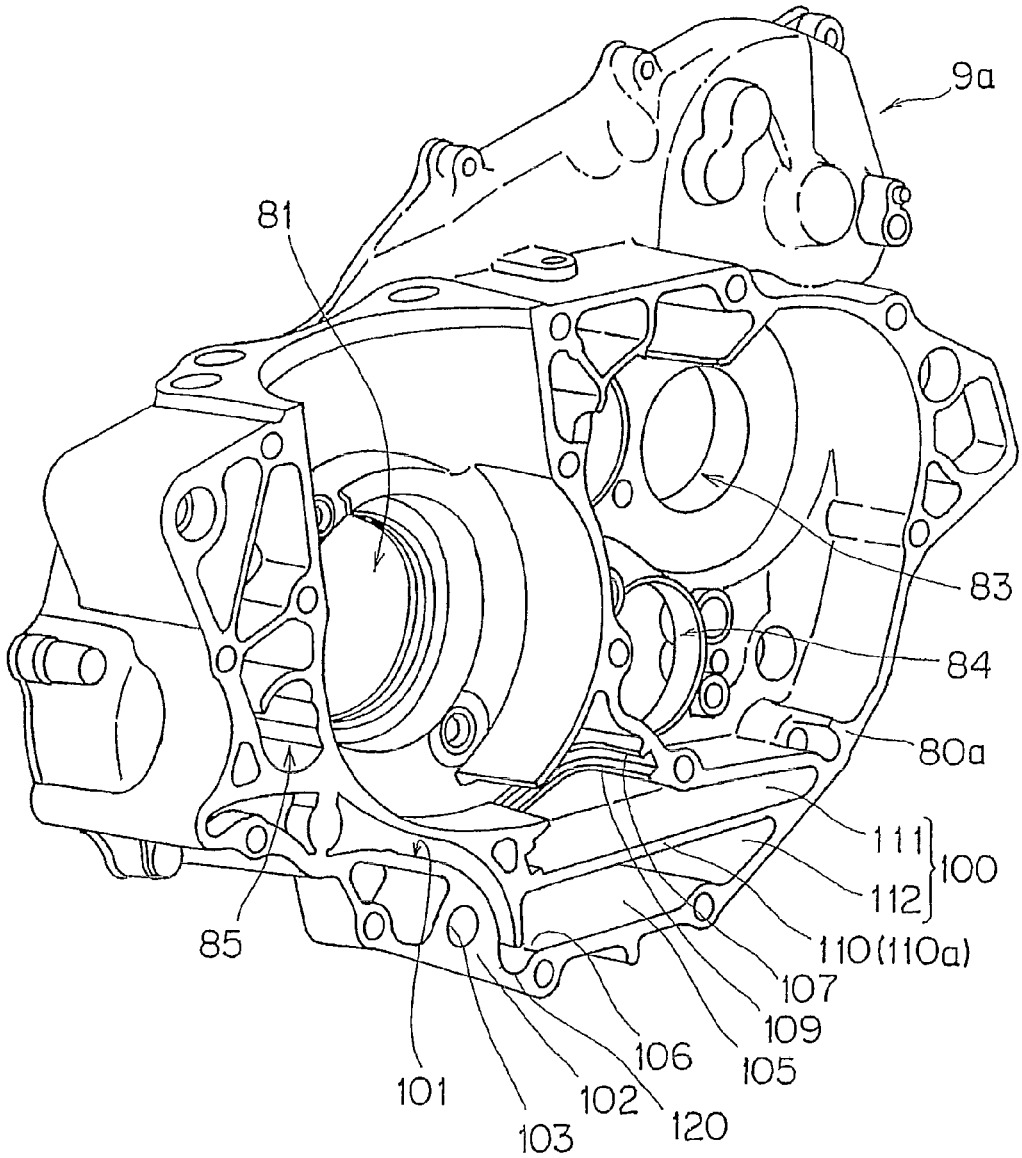
FIG. 8 is a perspective view of the right-side case as viewed from the mating surface side.

As shown in FIGS. 5 and 8, the first oil sump chamber 111 of the right-side case 9*a* is provided on the upper side thereof with an inflow port 107 for the oil flowing down from the crankshaft mounting part 81 side. A reed valve 108 (one-way valve) is mounted to the inflow port 107. The reed valve 108 is mounted in the manner of being fitted in a groove part 109 formed at an aperture edge part of the inflow port 107, and is opened and closed according to pressure variations at the time of sliding of the piston inside the sealed crank chamber, thereby preventing the oil from flowing back from the first oil sump chamber 111 side to the crank chamber side under a negative pressure.

In addition, as shown in FIGS. 7 and 8, the inflow port 107 and the reed valve 108 are provided only at the right-side case 9*a*. More specifically, the oil flowing in via the inflow port 107 flows from the right-side case 9*a* side to the left-side case 9*b* side, in the first oil sump chamber 111.

Figure 9:
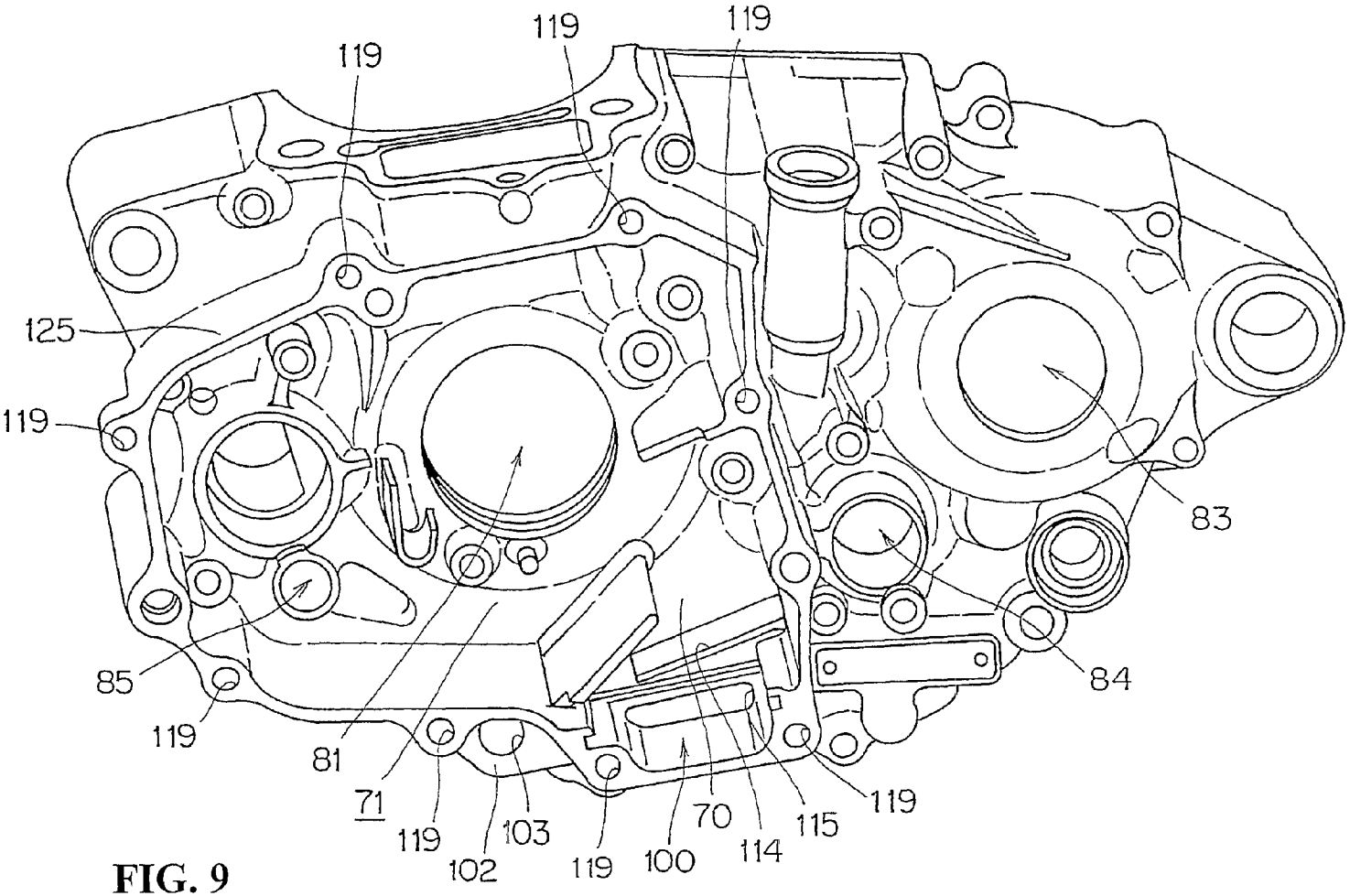
FIG. 9 is a perspective view of the left-side case as viewed from the side opposite to the side of the mating surface.

As shown in FIG. 6, the upper side of the first oil sump chamber 111 in the left-side case 9*b* is closed with an upper wall 113. A wall part 70 on the depth side in FIG. 6 of the first oil sump chamber 111 is provided with an oil outflow port 114. As shown in FIG. 9, the oil outflow port 114 penetrates to the generator chamber 71 side. In addition, as shown in FIG. 9, the generator chamber 71 is provided in its lower part with an oil introduction port 115 which makes the first oil sump chamber 111 and the second oil sump chamber 112 vertically communicate with each other. The oil introduction port 115 is formed with a groove part 116 in its aperture edge part, and a strainer 117 (see FIG. 7) is mounted in the manner of being fitted in the groove part 116, thereby covering the oil introduction port 115. The strainer 117 also has an effect of removing bubbles contained in the oil.

Figure 10:
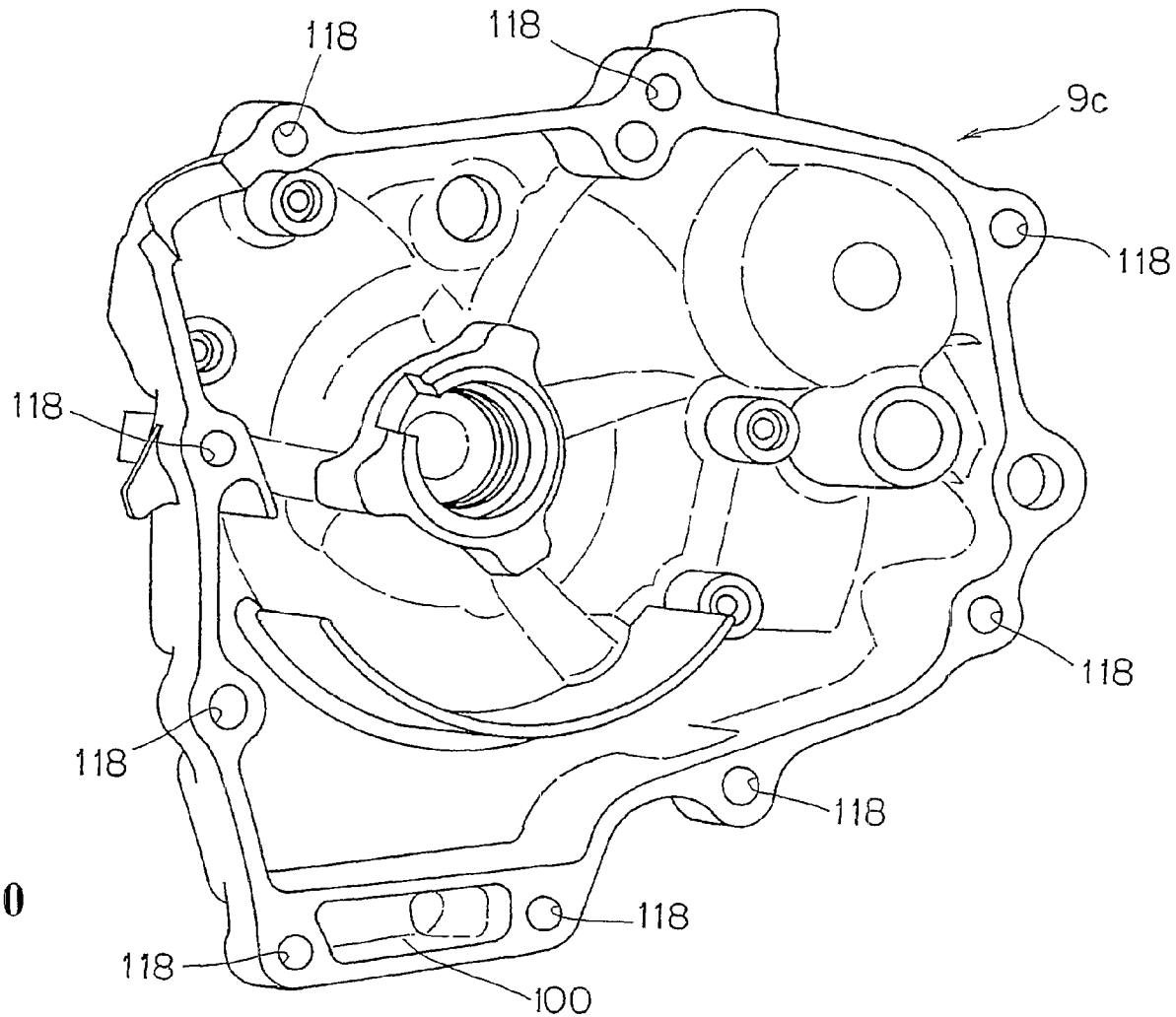
FIG. 10 is a perspective view of a crankcase cover as viewed from the inner side.

As shown in FIG. 9, on the outside of the left-side case 9*b*, an outer wall part 125 projecting from the wall part 70 to the side opposite to the side of the mating surface 80*b* is formed in a substantially circular ring-like shape, with the axis of the crankshaft 40 as a center of the circle. The outer wall part 125 is provided in its tip portion with a plurality of mounting holes 119 for attaching the crankcase cover 9*c*. On the other hand, as shown in FIG. 10, the crankcase cover 9*c* is provided in its outer circumferential portion with a plurality of mounting holes 118 at positions corresponding to the mounting holes 119. The crankcase cover 9*c* is attached to the left-side case 9*b* by fastening the mounting holes 118, 119 with bolts. As a result, the generator chamber 71 is defined by the wall part 70, the outer wall part 125, and the crankcase cover 9*c*. In addition, respective left side parts of the first oil sump chamber 111, the second oil sump chamber 112, and the oil introduction port 115 shown in FIG. 9 are covered with the crankcase cover 9*c*, so as to prevent the oil from leaking to the exterior.

This ensures that, as shown in FIG. 7, the oil having moved from the right-side case 9*a* side to the left-side case 9*b* side in the first oil sump chamber 111 flows out to the generator chamber 71 side in the manner of once flowing upward through the oil outflow port 114. With the oil once moved upward in this manner, bubbles contained in the oil are removed. Then, the bubbles are removed at the strainer 117, and thereafter the oil flows into the second oil sump chamber 112.

In addition, as shown in FIG. 3, the above-mentioned generator chamber 71 is provided at a left side part of the engine 7, and is provided therein with the generator 52. The cam chain 53 is disposed to run in the generator chamber 71. The oil splashed from the generator 52 and the cam chain 53 flows down to the oil introduction port 115, and passes through the strainer 117 into the oil sump chamber 100.

As shown in FIG. 5, the second oil sump chamber 112 is formed with an oil suction passage 101 having a curved path. In addition, an engine hanger boss 102 for mounting the engine 7 to the body frame 1 is formed on the front side of the second oil sump chamber 112, and a mounting hole 103 round in sectional shape is formed in the manner of penetrating in the vehicle body width direction. The oil pump mounting part 85 for mounting the oil pump 86 is formed on the front upper side of the engine hanger boss 102. Further, a round-shaped mounting boss 123 for coupling the right-side case 9*a* and the left-side case 9*b* to each other is formed on the lower side of a front part of the second oil sump chamber 112.

The oil suction passage 101 is a passage leading from the second oil sump chamber 112 to the oil pump 86, and the oil reserved in the second oil sump chamber 112 is pumped up by the oil pump 86 through the oil suction passage 101 and the oil filter 59.

As shown in FIG. 5, the oil suction passage 101 is formed in only the right-side case 9*a*. More specifically, the left-side case 9*b* is formed only with the mating surface 80*b* at a position corresponding to the oil suction passage 101 (see FIG. 6). In the condition where the right-side case 9*a* and the left-side case 9*b* are combined with each other, the mating surface 80*b* of the left-side case 9*b* closes a side part of the oil suction passage 101.

As shown in FIG. 5, the oil suction passage 101 extends from a front-side end part 106 of a bottom wall 105 of the second oil sump chamber 112 toward the vehicle body front lower side. Since the bubbles in the oil in the second oil sump chamber 112 rise to the liquid surface of the oil, pumping-up of the oil from the bottom wall 105 of the second oil sump chamber 112 reduces the amount of the bubbles contained in the oil being pumped up.

In addition, the oil suction passage 101 is formed with an R (round)-shaped part 124 along the R shape of the outer circumference of the mounting boss 123 located on the lower side of the front-side end part 106. The mounting boss 123 is preferably provided in the vicinity of the second oil sump chamber 112, in order to securely bring the mating surfaces 80*a*, 80*b* of the right-side and left-side cases 9*a*, 9*b* into firm contact with each other, thereby forming the second oil sump chamber 112. Therefore, by the structure in which the mounting boss 123 is located on the lower side of the front-side end part 106 and the oil suction passage 101 is disposed along the R shape of the outer circumference of the mounting boss 123, the inside volume of the second oil sump chamber 112 is secured to be large, and the vicinity of the mounting boss 123 is configured to be compact.

The oil suction passage 101 is formed with a bent part 120 at the lowest point position which is on the further lower side in relation to the bottom wall 105 of the second oil sump chamber 112. With the oil directed to the further lower side in relation to the bottom wall 105, the bubbles contained in the oil reserved in the vicinity of the bottom wall 105 are moved further upward, whereby the amount of the bubbles contained in the oil is reduced.

The oil suction passage 101 is formed with a vertical part 121 which rises upward from the bent part 120 along a vertical line V (see FIG. 5). In addition, an R-shaped part 122 is formed which is curved along the R shape of the mounting hole 103 of the engine hanger boss 102 from the upper end of the vertical part 121.

The vertical part 121 is for enabling effective utilization of the portion between the engine hanger boss 102 and the second oil sump chamber 112. More specifically, shifting of the position of the engine hanger boss 102 is not a good measure, in consideration of the weight balance of the engine 7 and the like. On the other hand, it is desirable that the inside volume of the second oil sump chamber 112 for reserving the oil should be as large as possible. In view of this, as shown in FIG. 5, the front-side end part 106 of the second oil sump chamber 112 is disposed as close to the engine hanger boss 102 as possible, thereby securely providing the second oil sump chamber 112 with a large inside volume, and the vertical part 121 is provided so as to obviate the interference of the oil suction passage 101 with the mounting hole 103 of the engine hanger boss 102. Further, with the oil suction passage 101 curved along the R shape of the mounting hole 103 from the upper end of the vertical part 121, the oil suction passage 101 is configured to be compact.

Furthermore, the oil suction passage 101 extends from the terminal end of the R-shaped part 122 to the oil pump mounting part 85 on the vehicle body front upper side.

According to the internal combustion engine pertaining to an embodiment of the present invention, the crankcase 9 is provided therein with the oil suction passage 101 which makes the oil pump 86 and the front-side end part 106 of the bottom wall 105 of the second oil sump chamber 112 communicate with each other, passes between the second oil sump chamber 112 and the engine hanger boss 102, and has the bent part 120 (as its lowest part) located below the bottom wall 105 of the oil sump chamber 100. Therefore, since the oil suction passage 101 is made to communicate with the front-side end part 106, it is unnecessary to form the oil suction passage 101 on the lower side of the bottom wall 105 of the oil sump chamber 100, so that the oil suction passage 101 is prevented from bulging to the lower side of the bottom wall 105. Therefore, an increase in the size of the crankcase 9 can be obviated. Accordingly, the ground clearance of the engine 7 can be prevented from being reduced.

In addition, since the bent part 120 is provided which is located below the bottom wall 105 of the second oil sump chamber 112, the upward movement of the bubbles contained in the oil to the liquid surface of the oil is further promoted when the oil located near the bottom wall 105 passes through the bent part 120. Thus, the amount of the bubbles contained in the oil passing through the bent part 120 can be reduced. Consequently, the amount of the bubbles sucked into the oil pump 86 can be reduced.

Further, the oil suction passage 101 has an oil passage of which a portion passing between the second oil sump chamber 112 and the engine hanger boss 102 partly extends in the vertical direction and which is disposed adjacent to the second oil sump chamber 112. This ensures that the region required for arranging the oil suction passage 101 can be effectively utilized in the vehicle body front-rear direction of the crankcase 9. Therefore, the second oil sump chamber 112 can be enlarged to the position adjacent to the oil suction passage 101, and the second oil sump chamber 112 can be securely provided with a large inside volume.

Furthermore, the crankcase 9 (9*a*, 9*b*) has the mounting boss 123 for coupling the right-side case 9*a* and the left-side case 9*b* to each other, the mounting boss 123 being adjacent to the oil suction passage 101, and the oil suction passage 101 is disposed along the outer circumference of the mounting boss 123. Therefore, with the R-shaped part 122 of the oil suction passage 101 formed along the R shape of the outer circumference of the mounting boss 123, it is possible to arrange the oil suction passage 101 and the mounting boss 123 close to each other. Accordingly, the inside volume of the second oil sump chamber 112 can be enlarged, and the oil suction passage 101 can be configured in a compact form, so that an increase in the size of the crankcase 9 can be obviated.

While one embodiment of the present invention has been described above, various changes and modifications are possible based on the technical thought of the invention.

For example, while the oil suction passage 101 is provided only in the right-side case 9*a* and is closed with the mating surface 80*b* of the left-side case 9*b* in the above-described embodiment, a reverse structure may be adopted, i.e., the oil suction passage 101 may be provided only in the left-side case 9*b*. Further, the oil suction passage 101 may be provided in each of the right-side and left-side cases 9*a*, 9*b*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a crankcase composed of a pair of cases, said cases being coupled to each other at mating surfaces orthogonal to an axis of a crankshaft;

an oil sump chamber located below said crankshaft and formed at a lower part of said crankcase in the manner of ranging across said mating surfaces;

an engine hanger boss provided in said crankcase and disposed adjacent to said oil sump chamber; and an oil pump for sucking oil from said oil sump chamber;

wherein said crankcase is provided therein with an oil suction passage for making said oil pump and an end part of a bottom wall of said oil sump chamber communicate with each other, passes between said oil sump chamber and said hanger boss, and has a lowest part located below said bottom wall of said oil sump chamber, wherein said oil sump chamber includes:

a first oil sump chamber and a second oil sump chamber, and an oil introduction port opening in a vertical direction providing for the oil from the first oil sump chamber to flow downwardly through the oil introduction port, and into the second oil sump chamber.

2. The internal combustion engine according to claim 1, wherein said oil suction passage has an oil passage of which a portion passing between said oil sump chamber and said engine hanger boss partly extends vertically and is disposed adjacent to said oil sump chamber.

3. The internal combustion engine according to claim 2, wherein said crankcase has a mounting boss for coupling of said crankcase, said mounting boss being provided adjacent to said oil suction passage, and said oil suction passage is disposed along the outer circumference of said mounting boss.

4. The internal combustion engine according to claim 1, wherein said crankcase has a mounting boss for coupling of said crankcase, said mounting boss being provided adjacent to said oil suction passage, and said oil suction passage is disposed along the outer circumference of said mounting boss.

5. The internal combustion engine according to claim 1, wherein a partition wall is disposed between the first oil sump chamber and the second oil sump chamber and extends across the pair of cases forming the crankcase.

6. The internal combustion engine according to claim 1, wherein said first oil sump chamber includes an inflow port for oil to flow down from a crankshaft mounting area to the first oil sump chamber with a one way valve being operatively mounted in a horizontal position within said inflow port.

7. The internal combustion engine according to claim 6, wherein said one way valve is a reed valve mounted in a groove part of the inflow port for being opened and closed according to pressure variations at the time of a sliding action of a piston mounted within said crankcase for preventing a flow of oil from the first oil sump chamber to the crankshaft mounting area.

8. The internal combustion engine according to claim 1, wherein said oil introduction port includes a groove part in an aperture edge part with a strainer being mounted to be fit into the groove for covering the oil introduction port, the strainer removing bubbles contained in the oil as the oil passes from the first oil sump chamber, to a generator chamber, through the strainer, and then into the second oil sump chamber.

9. An internal combustion engine, comprising:

a crankcase composed of a pair of cases, said cases being coupled to each other at mating surfaces orthogonal to an axis of a crankshaft;

an oil sump chamber located below said crankshaft and formed at a lower part of said crankcase in the manner of ranging across said mating surfaces;

an engine hanger boss provided in said crankcase and disposed adjacent to said oil sump chamber; and an oil pump for sucking oil from said oil sump chamber;

wherein said crankcase is provided therein with an oil suction passage for making said oil pump and an end part of a bottom wall of said oil sump chamber communicate with each other, passes between said oil sump chamber and said hanger boss, and has a lowest part located below said bottom wall of said oil sump chamber, and further including an oil outflow port in communication with the first oil sump chamber for directing oil upwardly into a generator chamber for removing bubbles from the oil prior to the oil being supplied to an oil introduction port for providing communication of oil from the first oil sump chamber to the second oil sump chamber.

10. An internal combustion engine comprising:

a crankcase including a first case and a second case being coupled to each other at mating surfaces orthogonal to an axis of a crankshaft;

an oil sump chamber located below said crankshaft and formed at a lower part of said crankcase;

an engine hanger boss formed in said crankcase, said engine hanger boss being disposed adjacent to said oil sump chamber; and an oil pump for sucking oil from said oil sump chamber;

wherein said crankcase is provided therein with an oil suction passage for providing communication between said oil pump and an end part of a bottom wall of said oil sump chamber, said oil suction passage being formed to pass between said oil sump chamber and said hanger boss with a lowest part of the oil suction passage being located below said bottom wall of said oil sump chamber, wherein the lowest part is a bent part of the oil suction passage formed as an indentation on an inner side of the bottom wall, and when the oil is directed to the bent part, bubbles contained in the oil reserved in a vicinity of the bottom wall are moved further upward, whereby an amount of the bubbles contained in the oil is reduced.

11. The internal combustion engine according to claim 10, wherein said oil suction passage has an oil passage of which a portion passing between said oil sump chamber and said engine hanger boss partly extends vertically and is disposed adjacent to said oil sump chamber.

12. The internal combustion engine according to claim 11, wherein said crankcase has a mounting boss for coupling of said crankcase, said mounting boss being provided adjacent to said oil suction passage, and said oil suction passage is disposed along the outer circumference of said mounting boss.

13. The internal combustion engine according to claim 10, wherein said crankcase has a mounting boss for coupling of said crankcase, said mounting boss being provided adjacent to said oil suction passage, and said oil suction passage is disposed along the outer circumference of said mounting boss.

14. The internal combustion engine according to claim 10, wherein said oil sump chamber includes a first oil sump chamber and a second oil sump chamber with a partition wall being disposed therebetween and extending across the first case and the second case forming the crankcase.

15. The internal combustion engine according to claim 14, and further including an oil introduction port for providing communication of oil from the first oil sump chamber to the second oil sump chamber.

16. The internal combustion engine according to claim 15, wherein said oil introduction port includes a groove part in an aperture edge part with a strainer being mounted to be fit into the groove for covering the oil introduction port, the strainer removing bubbles contained in the oil as the oil passes from the first oil sump chamber, to a generator chamber, through the strainer, and then into the second oil sump chamber.

17. The internal combustion engine according to claim 14, and further including an oil outflow port in communication with the first oil sump chamber for directing oil upwardly into a generator chamber for removing bubbles from the oil prior to the oil being supplied to an oil introduction port for providing communication of oil from the first oil sump chamber to the second oil sump chamber.

18. The internal combustion engine according to claim 10, wherein said first oil sump chamber includes an inflow port for oil to flow down from a crankshaft mounting area to the first oil sump chamber with a one way valve being operatively mounted in a horizontal position within said inflow port.

19. The internal combustion engine according to claim 18, wherein said one way valve is a reed valve mounted in a groove part of the inflow port for being opened and closed according to pressure variations at the time of a sliding action of a piston mounted within said crankcase for preventing a flow of oil from the first oil sump chamber to the crankshaft mounting area.

* * * * *